US006854613B2

(12) United States Patent
Biesecker et al.

(10) Patent No.: US 6,854,613 B2
(45) Date of Patent: Feb. 15, 2005

(54) CONTAINER AND CHILD-RESISTANT CLOSURE SYSTEM

(75) Inventors: Frederick N. Biesecker, Boyertown, PA (US); Gregory Sprishen, Collegeville, PA (US); Jason Robinson, East Greenville, PA (US)

(73) Assignee: Drug Plastics & Glass Company, Inc., Boyertown, PA (US)

( * ) Notice: Subject to any disclaimer, the term of this patent is extended or adjusted under 35 U.S.C. 154(b) by 0 days.

(21) Appl. No.: 10/436,424

(22) Filed: May 9, 2003

(65) Prior Publication Data

US 2004/0222181 A1 Nov. 11, 2004

(51) Int. Cl.[7] ..... B65D 50/04; B65D 50/08
(52) U.S. Cl. ..... 215/219; 215/218
(58) Field of Search ..... 215/216, 217, 215/218, 219, 221, 330, 334

(56) References Cited

U.S. PATENT DOCUMENTS

| | | | | | |
|---|---|---|---|---|---|
| 3,376,991 | A | | 4/1968 | Deaver | |
| 3,399,796 | A | | 9/1968 | Steiner | |
| 3,770,153 | A | * | 11/1973 | Gach et al. | 215/216 |
| 3,820,683 | A | | 6/1974 | Jasinski | |
| 3,841,514 | A | * | 10/1974 | Montgomery et al. | 215/216 |
| 3,984,021 | A | | 10/1976 | Uhlig | |
| 4,116,351 | A | | 9/1978 | Uhlig | |
| 4,117,945 | A | * | 10/1978 | Mumford | 215/216 |
| 4,134,513 | A | | 1/1979 | Mumford | |
| 4,138,028 | A | * | 2/1979 | Price et al. | 215/216 |
| 4,204,605 | A | | 5/1980 | Ravn et al. | |
| 4,351,442 | A | * | 9/1982 | Summers | 215/216 |
| 4,383,618 | A | | 5/1983 | Dougherty | |
| 4,436,211 | A | | 3/1984 | Gach | |
| 4,473,162 | A | | 9/1984 | Donoghue | |
| 4,588,097 | A | | 5/1986 | Hauser | |
| 4,967,921 | A | | 11/1990 | Pre et al. | |
| 5,603,421 | A | | 2/1997 | Opresco | |
| 5,915,576 | A | * | 6/1999 | Robinson | 215/216 |
| 5,988,412 | A | | 11/1999 | Minnette et al. | |
| 6,003,700 | A | | 12/1999 | Julian et al. | |
| 6,102,223 | A | | 8/2000 | Montgomery | |
| 6,105,801 | A | | 8/2000 | Minnette | |

* cited by examiner

*Primary Examiner*—Nathan J. Newhouse
(74) *Attorney, Agent, or Firm*—Akin Gump Strauss Hauer & Feld, LLP

(57) ABSTRACT

A combined container and child-resistant closure system includes a double-shell cap with a first skirt and a second skirt disposed within the first skirt. A pair of opposing protrusions extend from an interior surface of the first skirt. A pair of opposing finger pads are provided on an exterior surface of the first skirt. An interior surface of the second skirt is threaded. The container includes a threaded neck and a collar at the base of the neck. An outer edge of the collar forms an ellipse with major and minor axes. A pair of opposing notches are provided at apses of the major axis. When the cap is tightened onto the container, the protrusions mate with the notches to prevent removal of the cap unless the finger pads are compressed, deforming the first skirt such that the protrusions are released from the notches.

6 Claims, 3 Drawing Sheets

CONTAINER AND CHILD-RESISTANT CLOSURE SYSTEM

BACKGROUND OF THE INVENTION

The present invention relates to a container and child-resistant closure system intended for use with pharmaceuticals or other products which if improperly used pose a threat of injury or death.

Numerous designs exist within the prior art for child-resistant container closure systems. A particularly popular class of child-resistant closures are the so-called "squeeze and turn" closures, wherein a container cap must be manually deformed to release the cap from the container. As an example, U.S. Pat. No. 4,134,513 discloses a squeeze and turn cap which is compressed along a diameter to deform the cap and release it from the container. A first drawback associated with the prior art is that the degree of deformation required to release the cap is often significant, posing a substantial physical challenge, especially to persons with impaired hand strength. A second common drawback of the prior art is that the cap and container designs are frequently quite intricate, resulting in high manufacturing costs.

BRIEF SUMMARY OF THE INVENTION

According to a first aspect of the invention, a combination container and child-resistant closure system is disclosed. The system comprises a cap including a top having an outer circumference, the cap further including a first skirt depending from the outer circumference of the top and having a pair of opposing protrusions disposed on an interior surface, the protrusions being aligned along a first axis, and a pair of opposing finger pads on an exterior surface, the finger pads being aligned along a second axis which is generally perpendicular to the first axis. The cap further includes a second skirt depending from the top and disposed within and spaced from the first skirt, the second skirt having a threaded interior surface. The system also comprises a container including a neck forming an opening of the container, the neck having a threaded exterior surface and a collar at a base of the neck, the collar being generally elliptical in shape, an outer edge of the collar generally defining major and minor axes, a pair of opposing inwardly extending notches located generally at the apses of the major axis of the ellipse, each notch having a base wall and two side walls, said two side walls extending generally perpendicularly from the base wall. When the cap is threaded onto the neck by rotation of the cap relative to the container in a first direction, the cap advances onto the container neck until the protrusions are positioned within the collar notches, locking the cap onto the container and preventing further substantial rotation of the cap relative to the container in either the first or a second direction. A user may press inwardly on the pair of opposing finger pads, thereby deflecting the protrusions out of engagement with the notches, allowing the cap to be rotated in the second direction and removed from the container.

According to a second aspect of the invention, a child-resistant cap for a container having a neck forming an opening of a container is disclosed. The container neck has a threaded exterior surface and a collar at a base of the neck, the collar being generally elliptical in shape. An outer edge of the collar generally defines major and minor axes. The collar further includes a pair of opposing inwardly extending notches located generally at the apses of the major axis of the ellipse, each notch having a base wall and two side walls, the two side walls extending generally perpendicularly from the base. The child-resistant cap comprises a top having an outer circumference, a first skirt depending from the outer circumference of the top and having a pair of opposing protrusions disposed on an interior surface, the pair of protrusions being aligned along a first axis, and a pair of opposing finger pads on an exterior surface, the finger pads being aligned along a second axis which is generally perpendicular to the first axis. A second skirt depends from the top and is disposed within and spaced from the first skirt, the second skirt having a threaded interior surface. When the cap is threaded onto the neck by rotation of the cap relative to the container in a first direction, the cap advances onto the container neck until the protrusions are positioned within the collar notches, locking the cap onto the container and preventing further substantial rotation of the cap relative to the container in either the first or a second direction. A user may press inwardly on the pair of opposing finger pads, thereby deflecting the protrusions out of engagement with the notches, allowing the cap to be rotated in the second direction and removed from the container.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
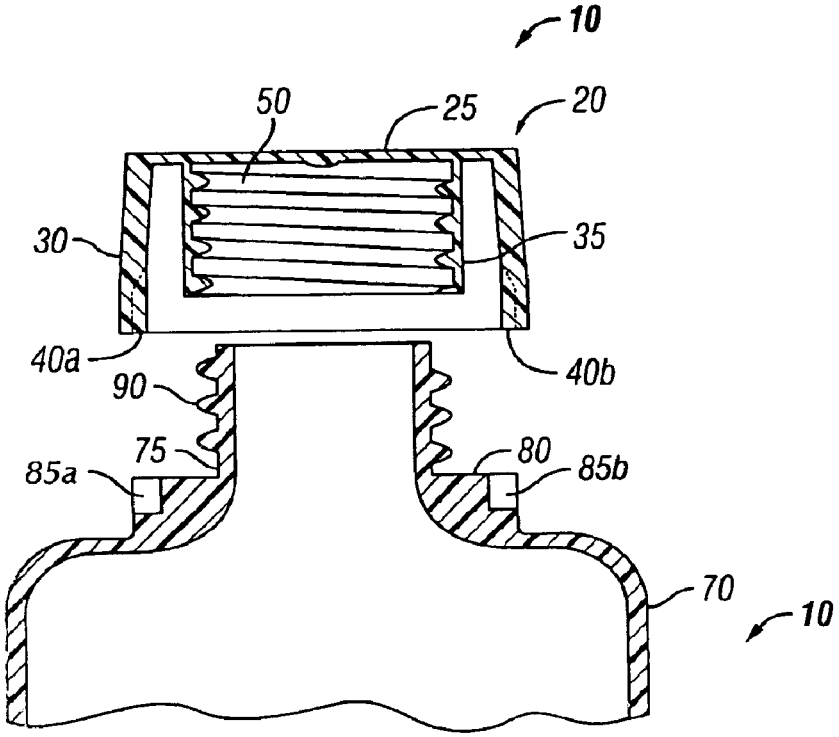
FIG. 1 is an exploded, elevational view ill central section of the dispensing end of a container and a child-resistant cap in accordance with a preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the container and child-resistant closure system and designated parts thereof. The terminology includes the words above specifically mentioned, derivatives thereof and words of similar import.

Referring to the drawings, wherein like numerals are used to indicate like elements throughout, there is shown in FIGS. 1–6, a preferred embodiment of a container and child-resistant closure system generally designated 10, in accordance with the present invention.

As is illustrated in FIGS. 1–6, the container and child-resistant closure system 10 comprises a double-shell cap 20 and a container 70. The cap 20 includes a top 25 with an outer circumference. A first skirt 30 depends from the outer circumference of the top 25. A second skirt 35 also depends from the top 25, the second skirt 35 being disposed within and spaced from the first skirt 30. An interior surface of the second skirt 35 is provided with threads 50. Along an interior surface of the first skirt 30, a pair of opposing rib-like protrusions 40*a* and 40*b* are provided. The first and second protrusions 40*a* and 40*b* are generally aligned along a first axis 45 (see FIG. 3). On an exterior surface of the first skirt 30, first and second finger pads 55*a* and 55*b* are provided, generally aligned along a second axis 60, the second axis 60 being generally perpendicular to the first axis 45.

In a preferred embodiment, the first skin 30 is generally cylindrical in shape. One of ordinary skill in the art would recognize from this disclosure that the first skirt 30 could have other forms, for example a first portion depending from the top 25 and shaped generally as a truncated cone and a second portion, depending from a lower edge of the first portion, shaped generally as a cylinder.

In a preferred embodiment, the finger pads 55*a* and 55*b* are formed as smooth and generally planar surfaces extending slightly from the exterior surface of the first skirt 30.

The container 70 includes a neck 75, an exterior surface of the neck 75 being provided with threads 90 adapted to mate with the cap threads 50. The container 70 further includes a collar 80 disposed at the base of the neck 75. An outer edge of the collar 80 generally forms an ellipse with major and minor axes, 95 and 100, respectively. A pair of notches 85*a* and 85*b* are formed at the apses of the major axis 95. The notches 85*a* and 85*b* each include two side walls 105 and a base wall 110.

Figure 2:
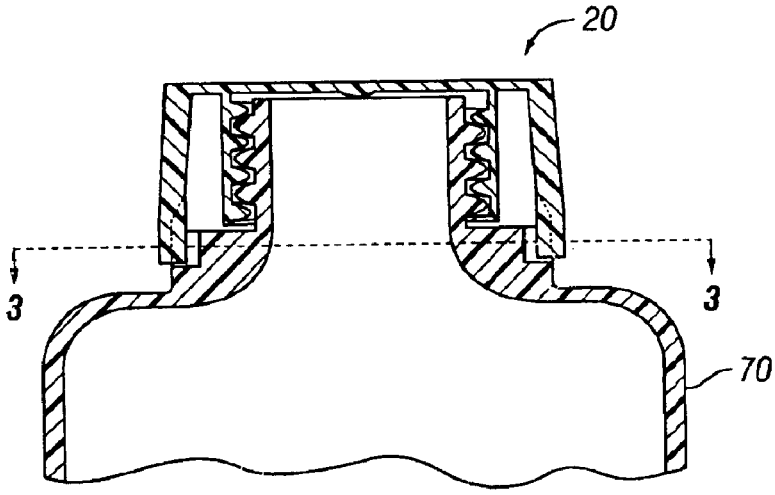
FIG. 2 is an elevational view in central section of the container and cap of FIG. 1 shown in an assembled and locked configuration.
Figure 3:
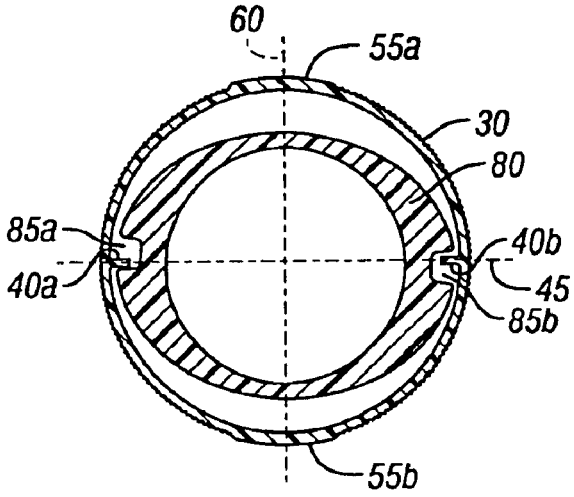
FIG. 3 is a sectional view taken along sectional plane 3—3 in FIG. 2.
Figure 4:
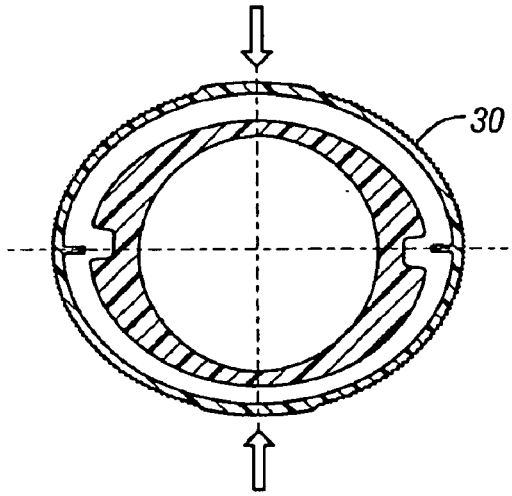
FIG. 4 is a sectional view similar to that of FIG. 3, showing the deformation of the cap resulting from compressing the outer skirt of the cap as indicated by the arrows.
Figure 5:
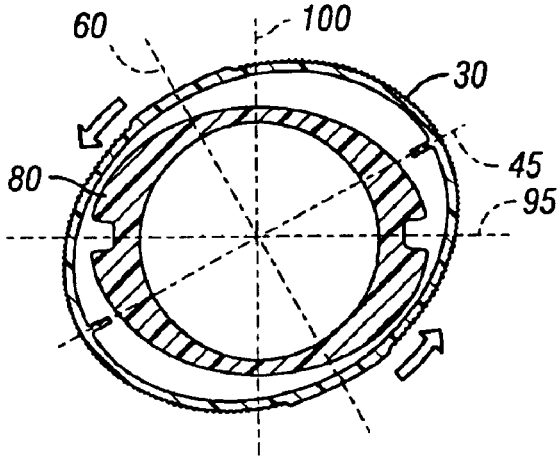
FIG. 5 is a sectional view similar to that of FIG. 3, showing the cap rotated in the direction of the arrows out of engagement with the container.
Figure 6:
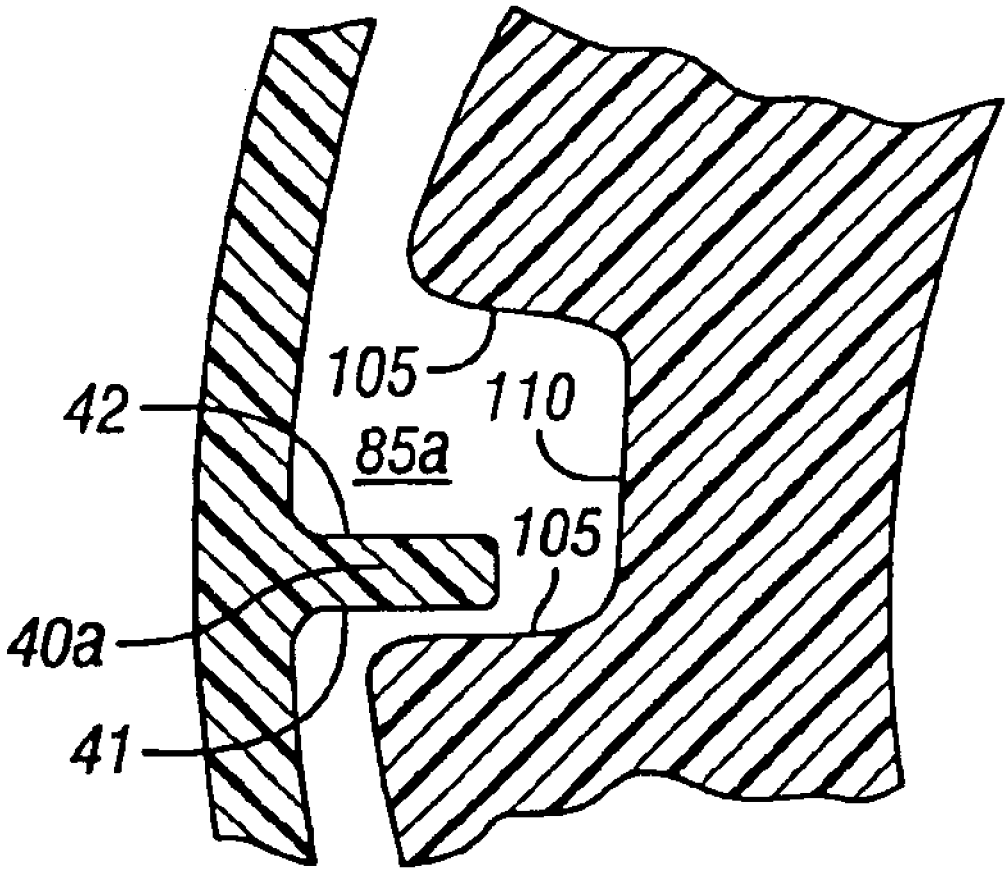
FIG. 6 is a detail view showing a locking feature of the cap.

A preferred embodiment of the protrusions 40*a* and 40*b* includes first and second major longitudinal sides 41 and 42, extending generally perpendicularly from the interior surface of the first skirt 30. When the protrusions 40*a* and 40*b* are locked into engagement with the notches 85*a* and 85*b*, as illustrated in FIGS. 2 and 3, the major longitudinal sides 41 and 42 are generally parallel with the side walls 105.

The cap 20 is preferably fabricated from a thermoplastic material using injection molding or other techniques well known to those skilled in the art. The container 70 is preferably also formed from a thermoplastic material, using blow molding or other techniques well-known to those skilled in the art. From this disclosure, one of ordinary skill in the art would recognize that other conventional materials and fabrication techniques could be substituted. Also based on this disclosure, the person of ordinary skill in the art would further recognize that the relative proportions of the components illustrated could be varied without departing from the spirit and scope of the invention.

In operation, the cap 20 is threaded onto the neck 75 by rotation of the cap 20 relative to the container 70 in a first direction, the cap 20 advancing onto the container neck 75 until the protrusions 40*a* and 40*b* are positioned within the notches 85*a* and 85*b*, locking the cap 20 onto the container 70 and preventing further substantial rotation of the cap 20 relative to the container 70 in either the first or a second direction. A user may press inwardly on the pair of opposing finger pads 55*a* and 55*b* (in the direction of the arrows in FIG. 4), thereby deflecting the protrusions 40*a* and 40*b* out of engagement with the notches 85*a* and 85*b*, allowing the cap 20 to be rotated in the second direction (indicated by the arrows in FIG. 5) and removed from the container 70.

A container and child-resistant closure system 10 is thus disclosed which provides a highly flexible and easily deformed outer skirt with locking protrusions 40*a* and 40*b*. The relatively thin wall of the first skirt 30 combined with the elliptically shaped container collar 80 allowing substantial travel of the finger pads 55*a* and 55*b* during disengagement of the protrusions 40*a* and 40*b* result in only minimal force being required to move the protrusions 40*a* and 40*b* out of engagement with mating notches 85*a* and 85*b*, thus allowing the cap 20 to be removed from the container 70. Furthermore, the system 10 involves very simple geometry, which enhances the ease of manufacture of the cap 20 and container 70, thus lowering the cost of the system 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A combination container and child-resistant closure system comprising:

a cap including a top having an outer circumference, the cap further including:

a first skirt depending from the outer circumference of the top and having a pair of opposing protrusions disposed on an interior surface, the protrusions being aligned along a first axis, and a pair of opposing finger pads on an exterior surface, the finger pads being aligned along a second axis which is generally perpendicular to the first axis;

a second skirt depending from the top and disposed within and spaced from the first skirt, the second skirt having a threaded interior surface;

a container including:

a neck forming an opening of the container, the neck having a threaded exterior surface; and a collar at a base of the neck, the collar being generally elliptical in shape and having a generally planar, continuous upper surface, an outer edge of the collar generally defining major and minor axes, a pair of opposing inwardly extending notches located generally at the apses of the major axis of the ellipse, each notch having a base wall and two side walls, said two side walls extending generally perpendicularly from the base wall, whereby when the cap is threaded onto the neck by rotation of the cap relative to the container in a first direction, the cap advances onto the container neck until the protrusions are positioned within the collar notches, locking the cap onto the container and preventing further substantial rotation of the cap relative to the container in either the first or a second direction and whereby a user may press inwardly on the pair of opposing finger pads, thereby deflecting the protrusions out of engagement with the notches, allowing the cap to be rotated in the second direction and removed from the container.

2. The child-resistant closure system of claim 1, wherein the first skirt extends axially from the top beyond the second skirt.

3. The child-resistant closure system of claim 1, wherein the cap is formed from a thermoplastic material.

4. The child-resistant closure system of claim 1, wherein the finger pads are formed by a pair of opposing smooth raised surfaces.

5. The child-resistant closure system of claim 1, wherein the protrusions are elongated ribs with two major longitudinal sides extending generally perpendicularly from the interior surface of the first skirt.

6. The child-resistant closure system of claim 5, wherein the longitudinal sides are generally parallel to the side walls of the notches when the protrusions are rotated into the locked position within the notches.

* * * * *